US007204274B2

(12) United States Patent
Mettler

(10) Patent No.: US 7,204,274 B2
(45) Date of Patent: Apr. 17, 2007

(54) HEDDLE WITH REDUCED PLAY

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 2 days.

(21) Appl. No.: 10/939,462

(22) Filed: Sep. 14, 2004

(65) Prior Publication Data

US 2005/0087252 A1 Apr. 28, 2005

(30) Foreign Application Priority Data

Sep. 15, 2003 (DE) ..... 103 42 577

(51) Int. Cl.
*D03C 9/00* (2006.01)

(52) U.S. Cl. ..... 139/93

(58) Field of Classification Search ..... 139/52, 139/91–96

See application file for complete search history.

(56) References Cited

U.S. PATENT DOCUMENTS

| | | | | |
|---|---|---|---|---|
| 2,047,511 A | | 4/1936 | Kaufmann | |
| 3,209,789 A | | 10/1965 | Munch | |
| 6,009,918 A | * | 1/2000 | Beyaert | 139/92 |
| 6,105,623 A | * | 8/2000 | Tonz et al. | 139/93 |
| 6,230,756 B1 | * | 5/2001 | Baumann et al. | 139/93 |
| 6,883,554 B2 | * | 4/2005 | Baumann et al. | 139/93 |
| 2003/0150506 A1 | | 8/2003 | Baumann et al. | |
| 2005/0016613 A1 | * | 1/2005 | Mettler et al. | 139/93 |

FOREIGN PATENT DOCUMENTS

| | | |
|---|---|---|
| CH | 402 767 | 5/1966 |
| JP | 2003-082550 A | 3/2003 |

OTHER PUBLICATIONS

International Organization for Standardization Standard 11677-2, 1994.*

Patent Abstracts of Japan, vol. 33, No. 7 (Jul. 3, 2003).

"Textile machinery and accessories—Main dimensions of flat steel healds with open end loops—Part 2: J-Shaped end loops", International Standard ISO 116-77, first edition, Nov. 15, 1994, pp. 1-2.

"Textile machinery and accessories—Main dimensions of flat steel healds with open end loops—Part 1: C-Shaped end loops", International Standard ISO 116-77, first edition, Nov. 15, 1994, pp. 1-2.

* cited by examiner

*Primary Examiner*—Gary Welch
*Assistant Examiner*—Andrew W. Sutton
(74) *Attorney, Agent, or Firm*—Norman N. Kunitz; Fitch, Even, Tabin & Flannery

(57) ABSTRACT

A heddle (14) of the invention is distinguished by end eyelets (15, 16) of reduced size, with which heddle support rails (6, 7) of reduced cross section are associated. The axial play of the heddles on the heddle support rails (6, 7) is limited to from 0.5 mm to 1.5 mm. The lateral play is in the range of 0.2 mm to 0.5 mm. This system formed of heddle support rails and heddles is especially suitable for particularly rigid heddle shafts for power looms with an extremely high operating speed.

19 Claims, 3 Drawing Sheets

HEDDLE WITH REDUCED PLAY

CROSS REFERENCE TO RELATED APPLICATION

This application claims the priority of German Patent Application No. 103 42 577.2, filed on Sep. 15, 2003, the subject matter of which, in its entirety, is incorporated herein by reference.

FIELD OF THE INVENTION

The invention relates to a heddle and its support rail, as well as to the system formed of the support rail and heddles seated on it.

BACKGROUND OF THE INVENTION

Power looms, for forming sheds or shedding, have heddle shafts with heddles that are retained on support rails. In operation, the heddle shafts are moved back and forth for shedding. With increasing operating speed of the power looms, the shedding must be done faster and faster, which leads to high dynamic loads on the heddle support rails and the heddles.

Shedding using heddle shafts on which heddles are retained is an old fundamental principle that has been employed for a long time. For instance, U.S. Pat. No. 2,047,511 discloses one such heddle shaft, which forms a rectangular frame. The upper and lower beams extending transversely to the direction of motion of the heddle shaft are called the shaft rod. Parallel to each of the two shaft rods is a respective heddle support rail, whose ends are retained on the side struts, connecting the shaft rods, of the heddle shaft. C-shaped end eyelets of heddles are seated on the heddle support rails and disposed in relatively large numbers parallel to one another in the heddle shaft.

A further fundamentally similar prior art is embodied by the heddle shaft described in Swiss Patent CH 402 767, on the heddle support rails of which heddles with J-shaped end eyelets are seated. In operation, the frame formed of the shaft rods and the side struts, like the heddle support rails, is subjected to dynamic deformation, which depending on the flexibility or rigidity of the arrangement and on the operating speed can become considerable. This deformation has the effect that under dynamic load, the spacings between the heddle support rails are not constant but instead locally vary. To keep these factors away from the heddles, the heddles are seated on the heddle support rails with considerable play.

The need to create relatively sturdy heddle support rails on the one hand and on the other to support the heddles with adequate play on the heddle support rails is reflected in ISO 11677-1, which for C-shaped end eyelets of weaving heddles prescribes an inner clearance height of 26.7 mm. The inner breadth of the end eyelet is 2.5 mm. These dimensions apply to heddle support rails which at present have a height of 22 mm and a breadth of 1.7 mm. Thus the heddles have more than 4 mm of play in the longitudinal direction and approximately 0.8 mm in the transverse direction.

The need at present is to design heddle shafts that are substantially stiffer than before, so that the expected dynamic deformations occur only at substantially higher operating speeds that before. However, these dynamic deformations can never be avoided entirely, because of the masses that must be accelerated and braked, which are brought to bear by the heddle shaft itself and by the heddle support rails, the heddles, and the warp yams that pass through the heddles.

With this as the point of departure, it is the object of the invention to improve the heddle shaft and the weaving heddles in such a way that higher operating speeds can be attained.

SUMMARY OF THE INVENTION

This object is attained with the weaving heddle of claim 1 and with the support rail of claim 9:

This object generally is attained with a weaving heddle of the invention, which in comparison to known weaving heddles, has at least an one C-shaped end eyelet of reduced size, whose inner free space has a height for example, 19.5 mm, preferably of at most 17.5 mm. This provision by itself already reduces the weight of the end eyelets compared to end eyelets that meet the ISO standard. The reduced mass reduces the forces that are required for accelerating and braking considerably. Moreover, the reduced height of the inner free space of the end eyelet makes it compulsory to use heddle support rails of reduced cross section and in particular reduced height. Although this lessens the rigidity of the heddle support rail, nevertheless the mass of the heddle support rails is also reduced considerably. At high accelerations, which are usual in modern power looms, the reduced mass reduces the forces of inertia more than would be necessary to compensate for the loss in rigidity. In conjunction with the reduction in the mass of the weaving heddles, the result is the capability of increasing the operating speed of a corresponding power loom.

The invention in particular takes into account the tendency to use more-rigid heddle shafts. If the height of the free space of the C-shaped end eyelet is a value of at most 19.5 mm, and if the height of the heddle support rail is 18 mm, for instance, the result is a longitudinal play (axial play) of the heddles of at most 1.5 mm. Compared to conventional heddle support rail systems, the longitudinal play of the heddles is reduced by a factor of 2 to 3. In cooperation with the use of rigid heddle shafts, higher speeds can be attained. The reduced heddle play in particular when the more-rigid heddle shafts are used reduces annoying noise and wear to the heddle support rails and heddle end eyelets.

The reduced height of the free space of the end eyelet leads to a reduced length of the end eyelet. If the end eyelet spacing remains the same, the total external length of the heddle thus drops. The heddle shaft therefore requires less space for receiving the heddles, and as a result the shaft rods can attain a greater breadth, measured in the direction of motion of the heddle shaft, while preserving the same external dimensions of the heddle shaft. As a result, they become substantially more rigid, which can be utilized to increase the operating speed of the power loom. Thus decreasing the height of the free space of the C-shaped end eyelet is the precondition for extensive optimization of heddle shafts in terms of the operating speed, noise, and wear.

The heddle support rail preferably now has a breadth of only about 1.5 mm; at least in a preferred embodiment, it is provided on at least one side with a longitudinally continuous indentation, or a plurality of individual indentations in line with one another. This indentation serves on the one hand to make the heddle support rail lighter in weight and on the other to make it possible to secure the heddle support rail to a shaft profile or to a connecting means with the shaft profile in a simple, secure way by means of a plurality of rivets. In the aforementioned indentation or groove, a half-round head of the rivet can be accommodated without hindering the displaceability of the heddles. The groove or indentation is also advantageous, since in what at 1.5 mm is a very thin heddle support rail, adequate countersinking for the rivet head can no longer be achieved reliably enough. The requisite effort and expense for adhering to close tolerances in achieving the functional reliability would be too high and hence uneconomical.

With this form of heddle support rail, other fastening methods that have been known, such as gluing, welding, or screwing, are also possible without further provisions.

With the present invention, a system of heddles and heddle support rails is created that overcomes the disadvantages caused by standardized dimensions and makes an optimal design of the system possible, as a result of which the production costs are reduced and the economy of the power looms equipped with it is improved.

Further details of advantageous embodiments of the invention will become apparent from the drawing, description or claims. In the drawing, exemplary embodiments of the invention are shown.

DETAILED DESCRIPTION OF THE INVENTION

Figure 1:
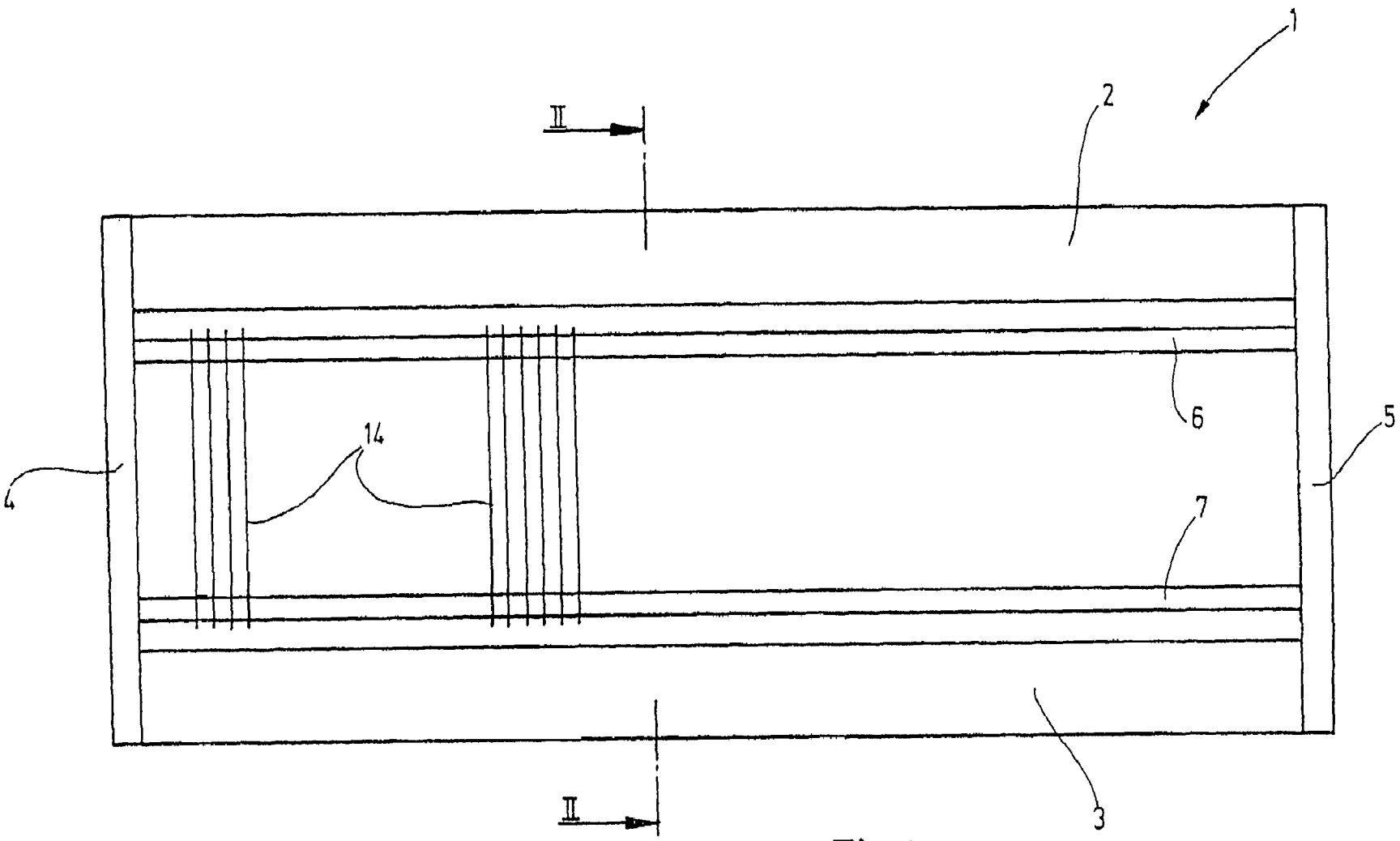
FIG. 1 is a schematic front view of a heddle shaft.
Figure 2:
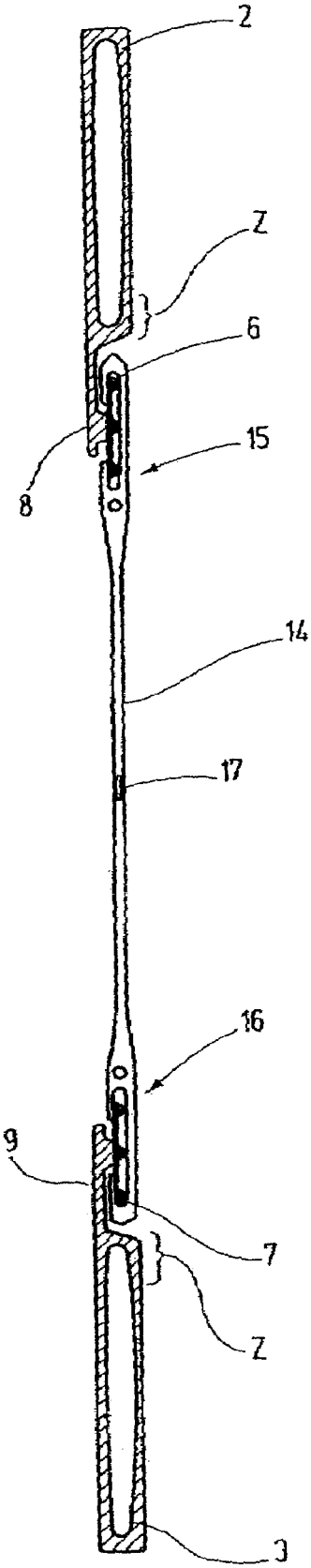
FIG. 2 is a schematic sectional view of the heddle shaft of FIG. 1.
Figure 4:
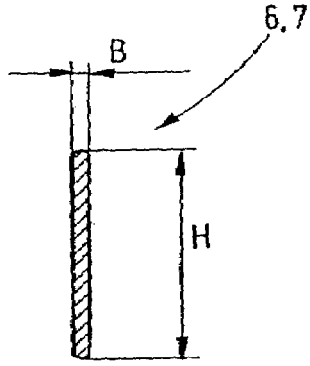
FIG. 4 is a sectional view showing the heddle support rail of FIG. 3 outside its fastening.
Figure 3:
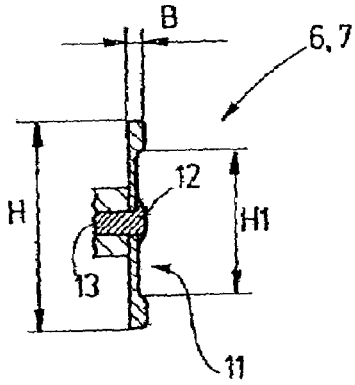
FIG. 3 is a fragmentary view on a different scale of the heddle shaft of FIG. 2 with its heddle support rail.

In FIG. 1, a heddle shaft 1 is shown, which has an upper shaft rod 2 and a lower, second shaft rod 3, disposed parallel to it at a distance. The ends of the shaft rods 2, 3 are joined together by side struts 4, 5, forming a firm rectangular frame. One heddle support rail 6, 7 each is retained on the upper and on the lower shaft rod 2, 3, as can also be seen from FIGS. 2 and 3. To that end, the shaft rods 2, 3 have extensions 8, 9, which support the heddle support rails 6, 7. As FIG. 3 shows, each of the heddle support rail 6, 7 is preferably embodied in the form of a flat steel profile, whose breadth B is preferably at least 1.2 mm and at most 1.5 mm and whose height H is, for example, 18 mm and preferably is at most 16 mm. The cross section is approximately rectangular; the heddle support rail 6, 7 is provided with a rounding on its top side. It may be provided, as FIG. 3 shows, at selected points with an indentation 11, whose height H1 is at most 14 mm and whose length (perpendicular to the plane of the drawing) is for instance 11 mm. As a result, only a minimal weakening of the solid profile otherwise present and shown in FIG. 4 is brought about. On the other hand, however, a free space is created for receiving a rivet head 12 of a connecting rivet 13 that serves to fasten the heddle support rail 6, 7 to the shaft rod 2, 3. The rivet head 12 may be embodied as a half-round head, for which there is space in the indentation 11 without its protruding beyond the outer contour of the support rail 6, 7.

On the support rails 6, 7, heddles 14 are retained parallel to and spaced apart from one another; they are seated on the heddle support rails 6, 7 with C-shaped end eyelets 15, 16 provided on both ends. A straight, flat shank extending between the end eyelets 15, 16 is provided approximately centrally with a yam eyelet 17. The heddle 14 is shown separately in FIG. 5. The shank extending between the two end eyelets 15, 16 is preferably bounded with parallel flanks by two straight edges 18, 19. If needed, the shaft may also be enlarged in the region of the yam eyelet 17, to make larger eyelets possible.

Figure 5:
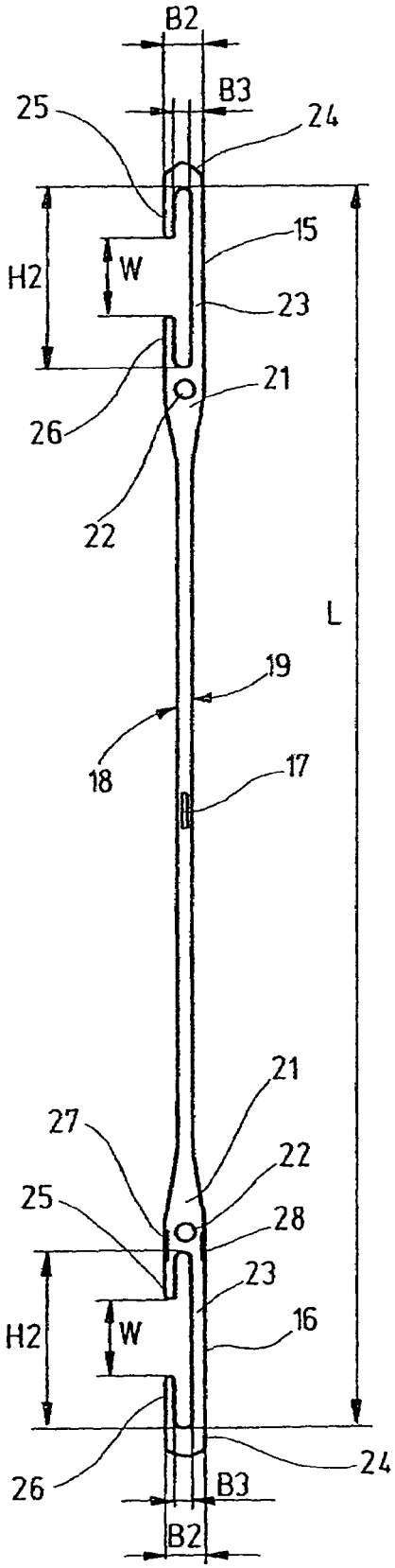
FIG. 5 is a side view of a weaving heddle for the heddle shaft of FIG. 1.

In the embodiment of FIG. 5, the shaft is disposed approximately centrally to the end eyelets 15, 16. The end eyelets 15, 16 are embodied substantially identically to one another. Initially, the shaft widens toward the end eyelet to the full breadth B2 of the end eyelet, which is preferably 4.5 mm. For special applications, different breadths may be provided, such as 5.56 mm as is currently usual, but 4.5 mm is preferred. The shaft thus changes over to a root region 21 of the respective end eyelet 15, 16. The two end eyelets 15, 16 are embodied essentially identically, so that the following description applies equally to both end eyelets 15, 16.

In the root region 21, a aligned hole 22 is embodied, for instance in the form of a round opening. A back stem 23 also extends away from the root region 21, and its length is from 18.5 mm to 19.5 mm. Its breadth is in the range from 1.5 mm to 2 mm. The back stem 23, on its end remote from the shaft, has a head region 24, which forms the upper boundary for the end eyelet 15 or the lower boundary for the end eyelet 16, as applicable. As for the end eyelet 15, the head region 24 may have an edge slanted in an inverted V, or as with the end eyelet 16, it may have an edge that is rounded toward the bottom. On the inside, both the head region 24 and the root region 21 are rounded.

Respective arms 25, 26 extend from the root region 21 and from the head region 24 toward one another, parallel to the back stem 23. The free ends of the arms 25, 26 between them define a passage with a width W, which depending on the height of the heddle support rail ranges between 3 mm and 8–10 mm. The width W is markedly less than the height H2 of an inner free space that is enclosed between the root region 21 and the head region 24 and serves to receive the heddle support rail 6, 7. Moreover, the breadth of the arms 25, 26 is less than that of the back stem. The spacings of the arms 25, 26 from the back stem 23 determine the inner breadth B3 of the free space. B3 is from 0.2 mm to 0.5 mm greater than the breadth B of the heddle support rail. The height H,. which preferably has a height of at least 14.5 mm, is greater by from 0.5 mm to 1.5 mm than the height H of the heddle support rail. A minimal axial or longitudinal play of 0.5 mm is provided, if the shaft rods 2, 3 are designed to be especially rigid. For lesser operating speeds of the power loom or more-flexible shaft rods, the play, or in other words the difference between H and H2, is increased to as much as 1.5 mm. Clamping or spring means that could restrict the free but slight play of the end eyelets 15, 16 on the heddle support rails 6, 7 are provided neither on the heddle support rail 6, 7 nor on the shaft rod 2, 3, nor on the heddles 14.

As FIG. 5 shows, on at least one of the end eyelets 15, 16, stamped features 27, 28 may be provided on both edges that are present in the root region 21 and are parallel to one another; these stamped features serve as separator edges and make it easier to separate heddles resting flatly against one another.

Compared to heddles with standardized end eyelets, the length L to be measured between the inner edges, remote from one another, of the two end eyelets 15, 16, is shortened by about 5 mm. The spacing between the edges, remote from one another, of the heddle support rails 6, 7 is correspondingly less, so that for the same outside dimension of the shaft, the shaft rods 2, 3 can be made higher. The increase in height is marked in FIG. 2 by "Z".

The heddle shaft 1 described thus far, in terms of its manipulation, matches a conventional heddle shaft. However, because of their increased breadth, the shaft rods 2, 3 are designed to be especially rigid. The heddles 14 have an axial play (transversely to the heddle support rails 6, 7) of only 0.5 mm to 1.5 mm. Thus even at very high operating speeds, in which the heddle shaft in FIG. 1 is moved very rapidly back and forth vertically parallel to the heddles 14, an excessive noise level and excessive wear on the end eyelets 15, 16 do not occur. The reduced mass of the end eyelets 15, 16 and of the heddle support rails 6, 7 furthermore reduces the requisite forces of acceleration, which makes increased operating speeds possible.

Figure 6:
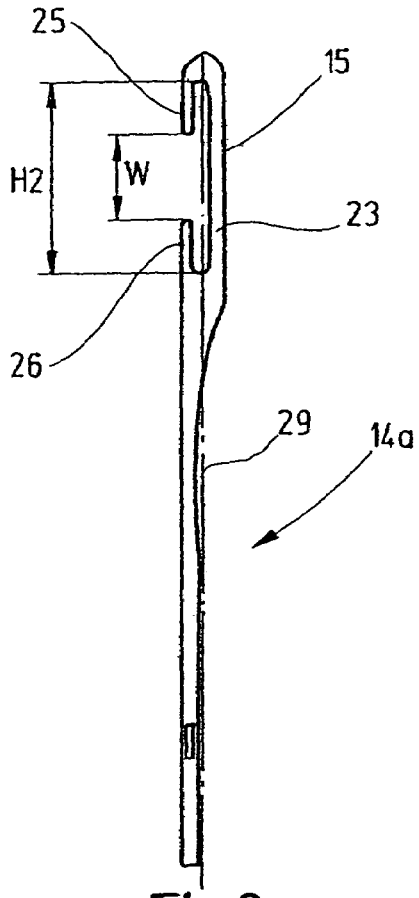
FIGS. 6 and 7 are fragmentary side views of modified embodiments of the weaving heddle.
Figure 7:
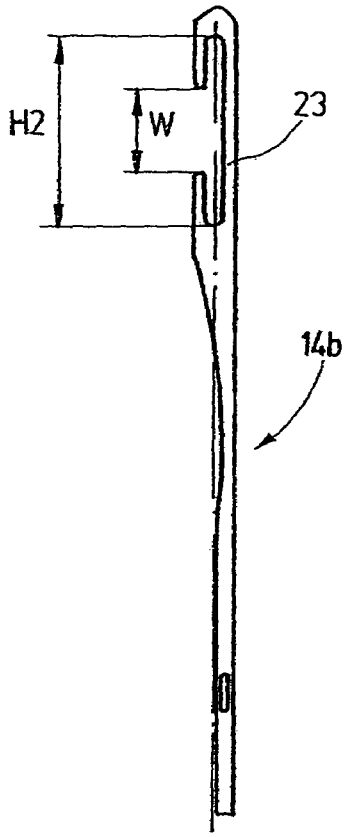
Figure 8:
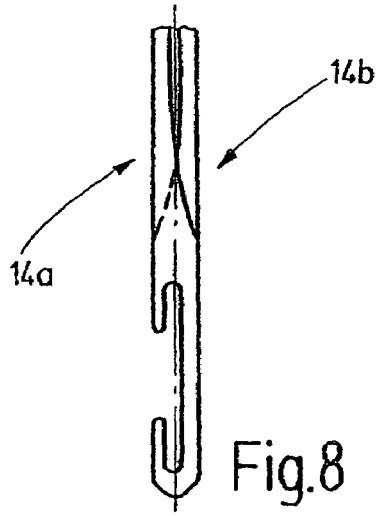
FIG. 8 is a fragmentary, schematic side view showing the pairing of the weaving heddles of FIGS. 6 and 7.

If needed, the end eyelets 15, 16 may be provided with a lateral bend or undulation, to create a certain spring elasticity. Moreover, the heddles 14 with shortened end eyelets 15, 16 may also be produced asymmetrically as shown in FIG. 6 or 7. In that case, the shaft is offset with respect to a center line 29 toward the back stem 23 (FIG. 7) or away from it (FIG. 6). Both heddles 14*a*, 14*b* may, as FIG. 8 shows, be disposed in alternation in one heddle shaft. In the heddles 14, 14*a*, 14*b* of the invention, it is possible to provide yam eyelets in all the desired shapes. The existing automatic drawing-in machines can therefore continue to be used.

A heddle 14 of the invention is distinguished by end eyelets 15, 16 of reduced size, with which heddle support rails 6, 7 of reduced cross section are associated. The axial play of the heddles on the heddle support rails 6, 7 is limited to from 0.5 mm to 1.5 mm. The lateral play is in the range of 0.2 mm to 0.5 mm. This system formed of heddle support rails and heddles is especially suitable for particularly rigid heddle shafts for power looms with an extremely high operating speed.

It will be appreciated that the above description of the present invention is susceptible to various modifications, changes and adaptations, and the same are intended to be comprehended within the meaning and range of equivalents of the appended claims.

LIST OF REFERENCE NUMERALS

1 Heddle shaft
2, 3 Shaft rods
4, 5 Side struts
6, 7 Heddle support rail
8, 9 Extension
11 Indentation
12 Rivet head
13 Connecting groove
14 Heddles
15, 16 End eyelets
17 Yam eyelet
18, 19 Edges
21 Root region
22 Aligned hole
23 Back stem
24 Head region
25, 26 Arms
27, 28 Stamped features
29 Center line
B Breadth
H Height
W Width
L Length

What is claimed is:

1. A weaving heddle for equipping heddle shafts, having first and second end eyelets, at each end of a shank, with each end eyelet having a back stem that connects a head region to a root region, and a first and a second arm, spaced apart from the back stem, extending away from the head region and root region, respectively, and wherein between the head region and the root region of each eyelet, a free space is embodied, with a height (H2), which amounts at most to 17.5 mm, to be measured parallel to the back stem.

2. The weaving heddle of claim 1, wherein the free space has a height (H2) of at least 14.5 mm.

3. The weaving heddle of claim 1, wherein the free space has a breadth (B3), to be measured between the back stem and the first or second arm, that amounts at most to 2 mm.

4. The weaving heddle of claim 1, wherein the free space has a breadth (B3) of at least 1.2 mm.

5. The weaving heddle of claim 1, wherein the back stem is embodied as straight.

6. The weaving heddle of claim 1, wherein the back stem is embodied with a bend.

7. The weaving heddle of claim 1, wherein the first and second arms each extend parallel to the back stem.

8. The weaving heddle of claim 1, wherein the free ends, pointing toward one another, of the arms have a spacing from one another of 3 mm to 8 mm.

9. The combination of a support rail supporting at least one weaving heddle wherein:

the heddle has respective first and second end eyelets at each end of a shank, with each end eyelet having a back stem that connects a head region to a root region, and a first and a second arm, spaced apart from the back stem, extending away from the head region and root region, respectively, and with a free space being formed between the head region and the root region of each eyelet, and having a height (H2), which amounts at most to 17.5 mm, to be measured parallel to the back stem; and, the support rail has an elongated straight body, whose cross section has a height (H) of at most 16 mm and a breadth (B) of at most 1.5 mm.

10. The combination of claim 9, wherein the longitudinal play, to be measured parallel to the back stem, of the end eyelet on the heddle support rail is between 0.5 mm and 1.5 mm.

11. The combination of claim 9, wherein the play, to be measured transversely to the back stem, of the end eyelet on the heddle support rail is between 0.2 mm and 0.5 mm.

12. The arrangement of a support rail supporting at least one weaving heddle, wherein:

the heddle has a respective end eyelet at each end of a shank, with each end eyelet having a back stem that connects a head region to a root region, and first and second arms, that are spaced apart from the back stem and that extend away from the head region and root region, respectively and toward each other, to form a free space, between the arms and the back stem, that extends from the head region to the root region;

the support rail has an elongated straight body; and, the free space of each eyelet has a height that is 0.5–1.5 mm greater than the height of the support rail, so that the longitudinal play, measured parallel to the back stem, between the end eyelet and the heddle support rail is between 0.5 mm and 1.5 mm.

13. The arrangement of claim 12, wherein the free space has a height (H2) of at most 17.5 mm.

14. The arrangement of claim 12, wherein the free space has a breath that is 0.2–0.5 mm larger than the breath of a support rail to be used with the heddle.

15. The arrangement of claim 14, wherein the free space has a breath of at most 1.5 mm.

16. The arrangement of claim 12 wherein a cross section of the support rail has a height of at most 16 mm and a breadth of at most 1.5 mm.

17. The arrangement of claim 12 wherein the play, measured transversely to the back stem, of the end eyelet on the heddle support rail is between 0.2 mm and 0.5 mm.

18. The arrangement of claim 17 wherein to a cross section of the support rail has a breadth of at most 1.5 mm.

19. The arrangement of claim 12 including a pair of said support rails that are spaced from each other, and with each of the support rails supporting a respective end eyelet of the at least one heddle.

* * * * *